US007744403B2

(12) United States Patent
Barr et al.

(10) Patent No.: US 7,744,403 B2
(45) Date of Patent: Jun. 29, 2010

(54) CONNECTOR FOR ELECTRICAL CABLES

(75) Inventors: Alexander W. Barr, Austin, TX (US); Richard J. Scherer, Austin, TX (US); Joseph N. Castiglione, Cedar Park, TX (US); George R. Hare, Austin, TX (US); Jesse A. Mann, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/939,305

(22) Filed: Nov. 13, 2007

(65) Prior Publication Data

US 2008/0124974 A1 May 29, 2008

Related U.S. Application Data

(60) Provisional application No. 60/867,763, filed on Nov. 29, 2006.

(51) Int. Cl.
*H01R 12/24* (2006.01)

(52) U.S. Cl. ..... 439/499; 439/687

(58) Field of Classification Search ..... 439/499, 439/581, 607, 687, 731
See application file for complete search history.

(56) References Cited

U.S. PATENT DOCUMENTS 4,184,734 A * 1/1980 Toorell ..... 439/340
5,184,965 A * 2/1993 Myschik et al. ..... 439/578
5,489,223 A * 2/1996 Faje et al. ..... 439/748
5,632,634 A * 5/1997 Soes ..... 439/101
5,993,268 A * 11/1999 Yamaguchi ..... 439/752.5
6,203,369 B1 * 3/2001 Feldman ..... 439/579
6,368,120 B1 4/2002 Scherer et al.
6,478,635 B2 * 11/2002 Charles et al. ..... 439/851
6,780,069 B2 8/2004 Scherer et al.
6,830,480 B2 12/2004 Yoshioka
7,004,793 B2 * 2/2006 Scherer et al. ..... 439/610

FOREIGN PATENT DOCUMENTS

DE 41 16 166 7/1992
JP 8096864 A 4/1996
JP 10092506 A 4/1998
JP 11074037 A 3/1999
JP 2002319458 A 10/2002

* cited by examiner

*Primary Examiner*—Thanh-Tam T Le
(74) *Attorney, Agent, or Firm*—Johannes P. M. Kusters

(57) ABSTRACT

A connector for electrical cables includes a tubular housing of electrically conductive material, an inner housing of electrically insulating material, and a plurality of electrical contacts positioned in the inner housing. The electrical contacts are configured to be connected to a conductor of an electrical cable and include two sides, each side having a discontinuous contact positioning feature. Optionally, the inner housing includes a substantially hollow center wall having a plurality of wall reinforcement ribs. A terminated cable assembly includes the connector for electrical cables and an electrical cable electrically connected to the connector.

12 Claims, 8 Drawing Sheets

CONNECTOR FOR ELECTRICAL CABLES

CROSS-REFERENCE TO RELATED APPLICATIONS

The present application claims priority to U.S. Provisional Patent Application 60/867,763, filed Nov. 29, 2006.

TECHNICAL FIELD

The present invention relates to a connector for electrical cables, in particular electrical cables having a small diameter.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as signal transmission times) have been slow when compared to the length of time required for a signal to propagate through a conductor in the interconnect or in the printed circuit board. As user requirements grow more demanding with respect to both interconnect sizes and signal transmission times, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

At least one aspect of the present invention pertains to a connector for electrical cables designed to provide an improved electrical performance over connectors for electrical cables currently known in the art. The connector may be part of a terminated cable assembly wherein an electrical cable is electrically connected to the connector.

In one aspect, the present invention provides a connector for electrical cables comprising a tubular housing, an inner housing, and a plurality of electrical contacts positioned in the inner housing. The tubular housing of electrically conductive material has inner walls defining an opening and first and second opposed open ends. The inner housing of electrically insulating material is adapted to be inserted into the tubular housing from at least one of the open ends thereof and comprises inner spaces configured to receive electrical contacts in fixed relative positions. The electrical contacts are configured to be connected to a conductor of an electrical cable and include two sides, each of which has a discontinuous contact positioning feature. Optionally, the inner housing may further include a substantially hollow center wall having a plurality of wall reinforcement ribs.

In another aspect, the present invention provides a connector for electrical cables comprising a tubular housing, an inner housing, and a plurality of electrical contacts positioned in the inner housing. The tubular housing of electrically conductive material has inner walls defining an opening and first and second opposed open ends. The inner housing of electrically insulating material is adapted to be inserted into the tubular housing from at least one of the open ends thereof and comprises inner spaces configured to receive electrical contacts in fixed relative positions. The inner housing further includes a substantially hollow center wall having a plurality of wall reinforcement ribs. The electrical contacts are configured to be connected to a conductor of an electrical cable.

In yet another aspect, the present invention provides a terminated cable assembly including the connector of the present invention for electrical cables and an electrical cable electrically connected to the connector.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
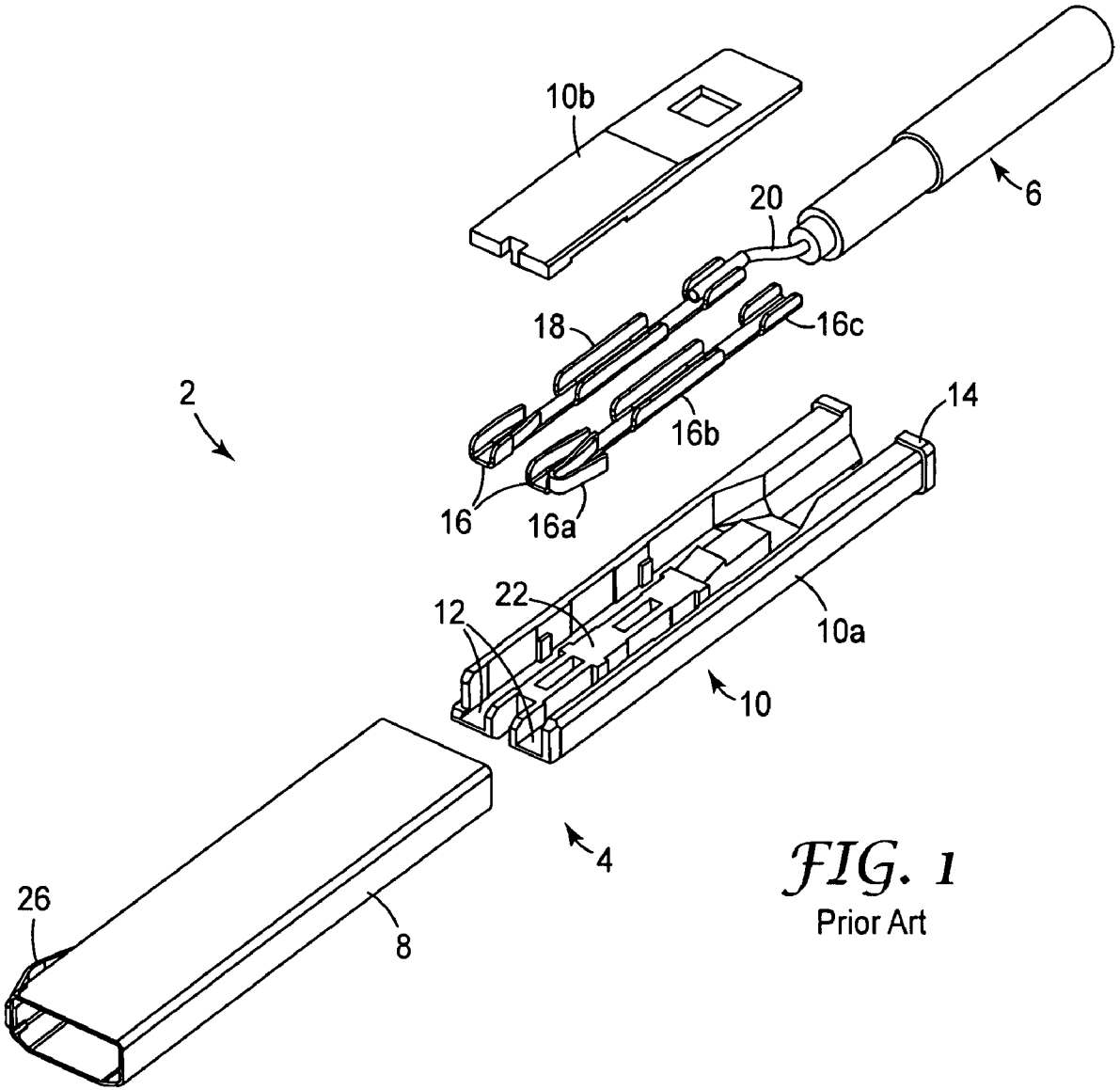
FIG. 1 Prior Art
FIG. 1 is an exploded perspective view of an exemplary embodiment of a prior art connector for electrical cables.

The present invention is best understood and appreciated by comparing it with a prior art connector. FIG. 1 illustrates such a prior art connector. It shows terminated cable assembly 2 wherein connector for electrical cables 4 is connected to electrical cable 6. Connector for electrical cables 4 includes tubular housing 8, inner housing 10, and electrical contacts 16. Tubular housing 8 is made from an electrically conductive material and has inner walls defining an opening and first and second opposed open ends. Optionally, it has one or more external ground contacts 26 configured to make electrical contact e.g. with a ground contact of a mating connector, or with a ground contact pad on a printed circuit board. Inner housing 10 is made from an electrically insulating material and can be a single part housing (not shown) or a multiple part housing. FIG. 1 illustrates an example of a multiple part housing including inner housing part 10*a* and inner housing part 10*b*. In assembly, inner housing part 10*a* and inner housing part 10*b* are kept in relative position by tubular housing 8 in combination with positioning features on the inner housing parts. Inner housing part 10*a* includes stop 14 configured to assist in properly positioning inner housing 10 in tubular housing 8. In addition, it includes inner spaces 12 configured to receive electrical contacts 16, separated by substantially solid inner housing center wall 22. Electrical contacts 16 are conventional in design. They are formed of sheet material into a generally u-shaped form and include front passage-shaped plug-in portion 16*a*, contact positioning portion 16*b*, and rear connection portion 16*c*. Front passage-shaped plug-in portion 16*a* is configured to be separably electrically connected to an electrical contact of a suitable mating connector. Contact positioning portion 16*b* includes continuous contact positioning feature 18 on each side of the contact substantially extending along the entire length of contact positioning portion 16*b*. Rear connection portion 16*c* is configured to be electrically connected to conductor 20 of electrical cable 6. Electrical cable 6 is attached to connector for electrical cables 4 through the use of a solder opening such as opening 128 shown in FIG. 4. The type of electrical cable used in this exemplary embodiment present in the current art can be a single wire cable (e.g. single coaxial or single twinaxial) or a multiple wire cable (e.g. multiple coaxial or multiple twinaxial or twisted pair cables).

Figure 2:
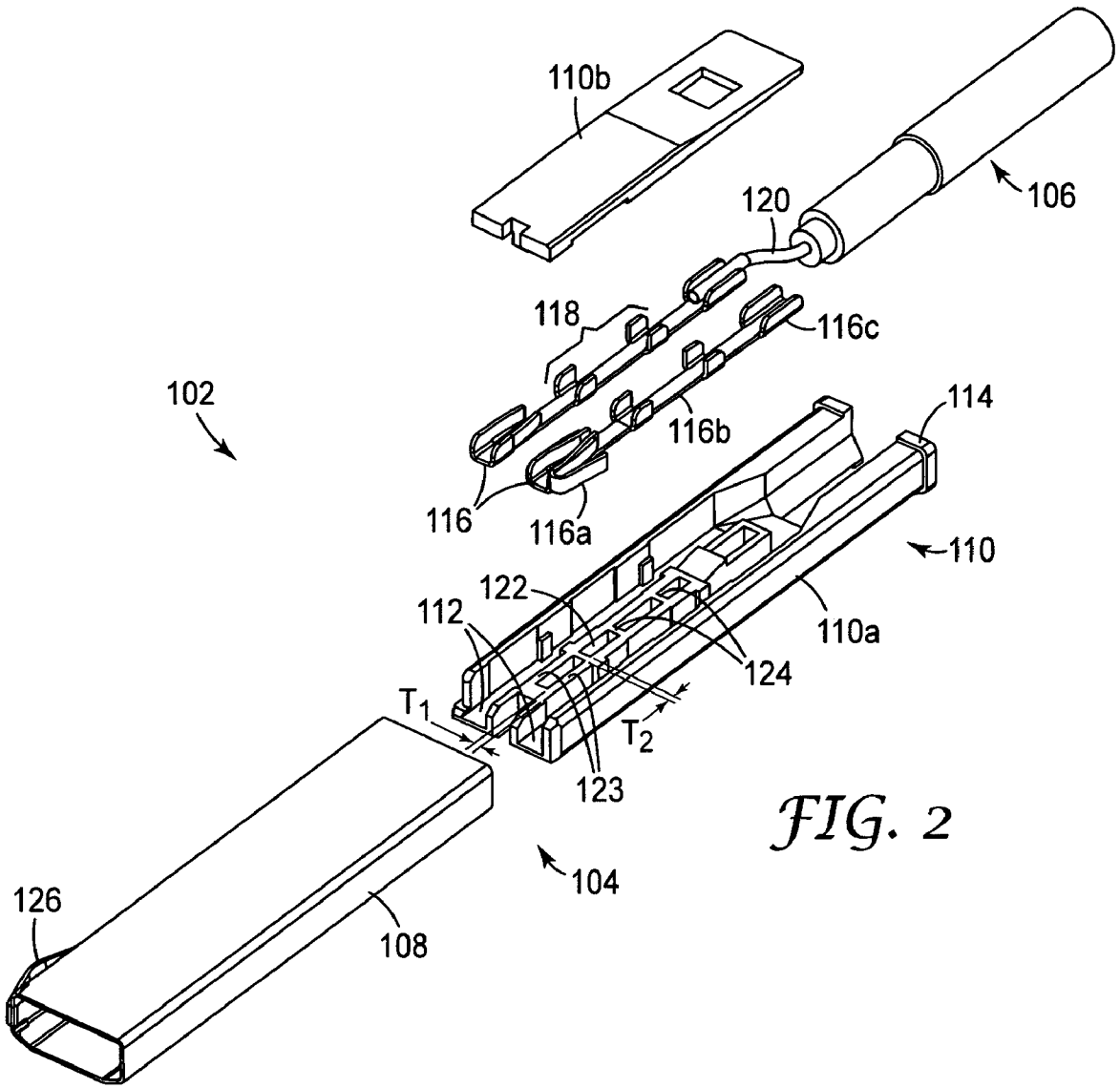
FIG. 2 is an exploded perspective view of an exemplary embodiment of a connector for electrical cables according to the present invention.
Figure 3:
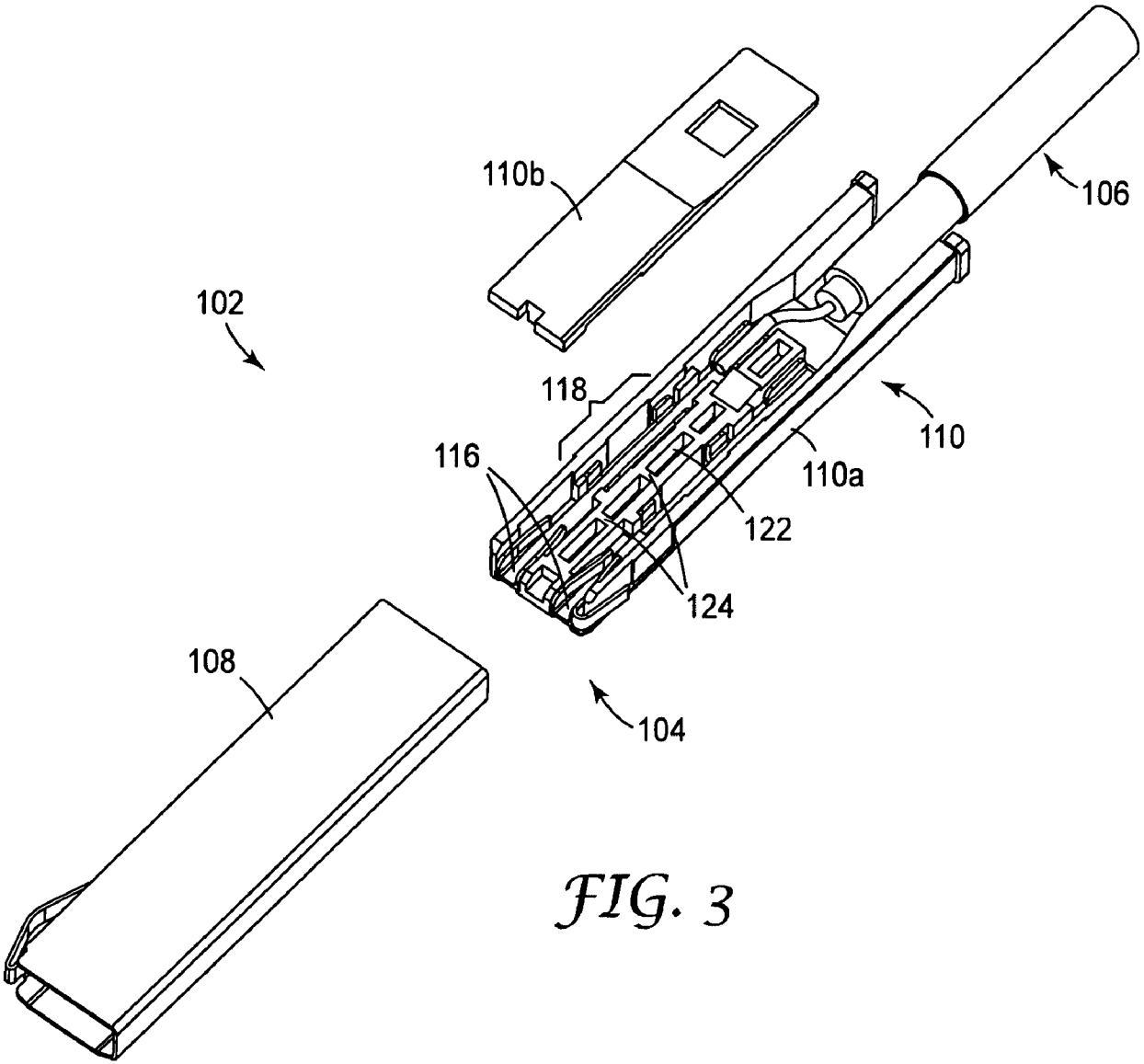
FIG. 3 is a partially exploded perspective view of the connector of FIG. 2.
Figure 4:
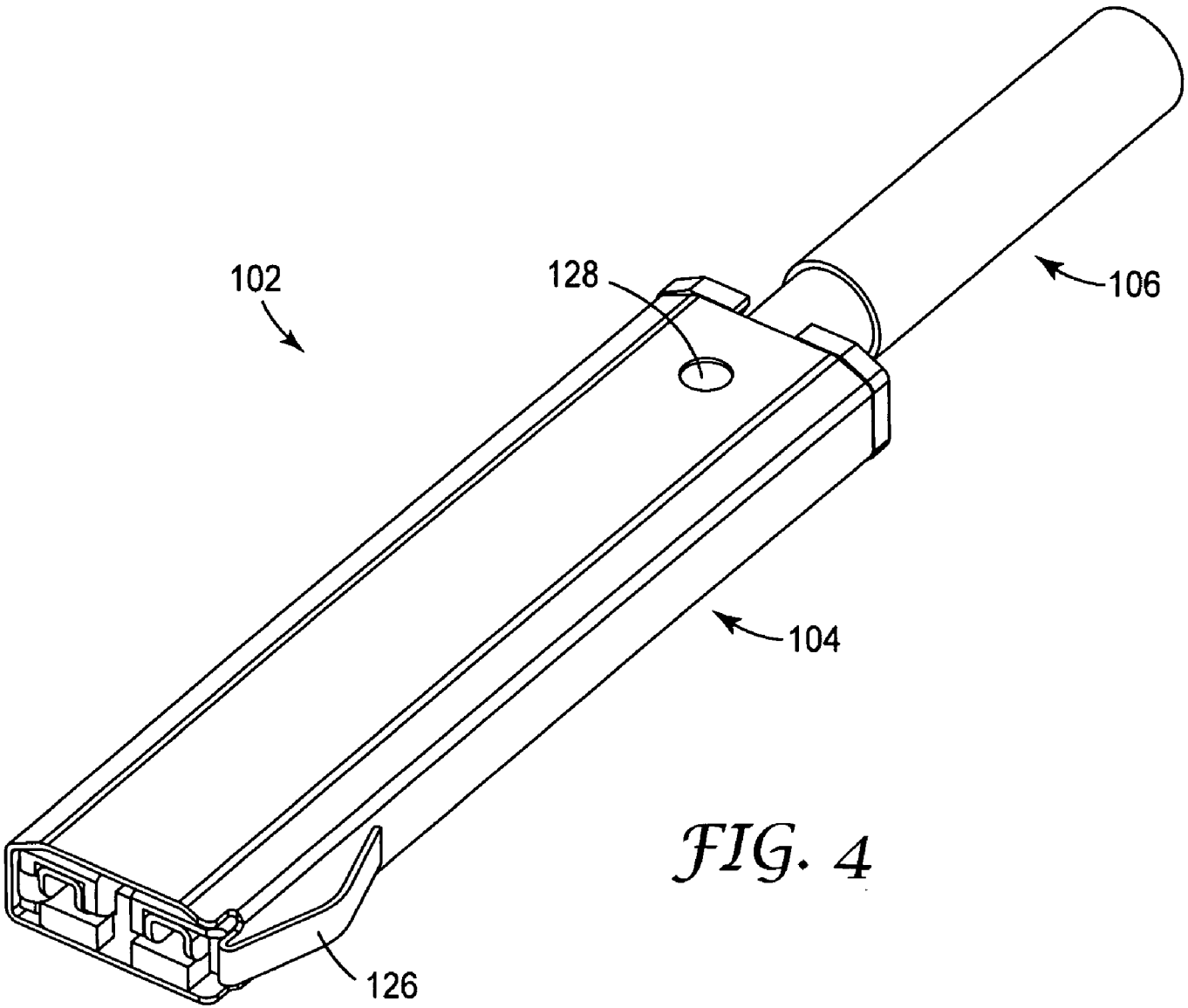
FIG. 4 is a perspective view of the connector of FIG. 2.

FIGS. 2, 3, and 4 illustrate an exemplary embodiment of the present invention. It shows terminated cable assembly 102 wherein connector for electrical cables 104 is connected to electrical cable 106. Connector for electrical cables 104 includes tubular housing 108, inner housing 110, and electrical contacts 116. Tubular housing 108 is made from an electrically conductive material and has inner walls defining an opening and first and second opposed open ends. Optionally, it has one or more external ground contacts 126 configured to make electrical contact e.g. with a ground contact of a mating connector, or with a ground contact pad on a printed circuit board. Inner housing 110 is made from an electrically insulating material and can be a single part housing (not shown) or a multiple part housing. FIGS. 2 and 3 illustrate an example of a multiple part housing including inner housing part 110*a* and inner housing part 110*b*. In assembly, inner housing part 110*a* and inner housing part 110*b* are kept in relative position by tubular housing 108 in combination with positioning features on the inner housing parts. Inner housing part 110*a* includes stop 114 configured to assist in properly positioning inner housing 110 in tubular housing 108, as can be seen in FIG. 4. In addition, it includes inner spaces 112 configured to receive electrical contacts 116, separated by substantially hollow inner housing center wall 122. Inner housing center wall 122 includes wall portions 123, each having a thickness $T_1$. Optionally, substantially hollow inner housing center wall 122 has a plurality of wall reinforcement ribs 124 configured to provide structural integrity of the wall. In one embodiment, wall reinforcement ribs 124 have a thickness $T_2$ that is substantially the same as thickness $T_1$ of side walls 123. Electrical contacts 116 are formed of sheet material into a generally u-shaped form and include front passage-shaped plug-in portion 116*a*, discontinuous contact positioning portion 116*b*, and rear connection portion 116*c*. Front passage-shaped plug-in portion 116*a* is configured to be separably electrically connected to an electrical contact of a suitable mating connector. Contact positioning portion 116*b* includes discontinuous contact positioning feature 118 on each side of the contact. Discontinuous contact positioning feature 118 may include one or more apertures, recesses, openings, or slots, two or more sections, or a combination thereof. FIGS. 2 and 3 illustrate the example of discontinuous contact positioning feature 118 including two sections positioned on the ends of contact positioning portion 116*b*. Rear connection portion 116*c* is configured to be electrically connected to conductor 120 of electrical cable 106. Electrical cable 106 is attached to connector for electrical cables 104 through the use of a solder opening such as opening 128 shown in FIG. 4. The type of electrical cable used in this exemplary embodiment can be a single wire cable (e.g. single coaxial or single twinaxial) or a multiple wire cable (e.g. multiple coaxial or multiple twinaxial or twisted pair cables).

Figure 5A:
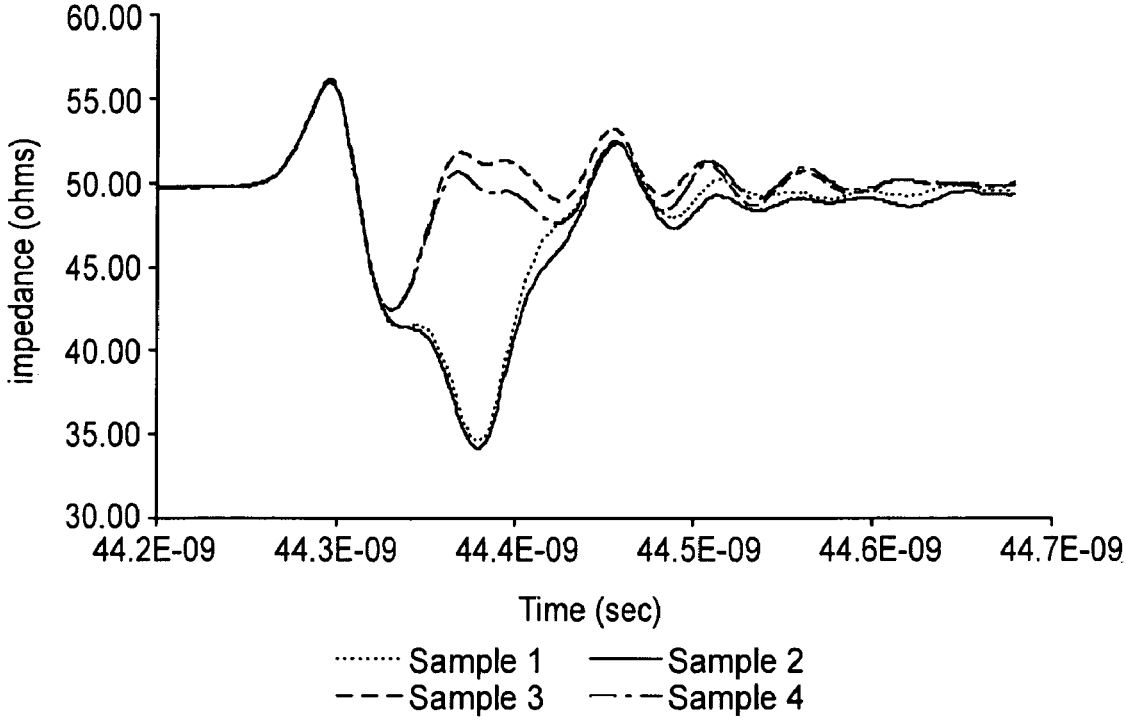
FIG. 5*a*-5*c* are graphs illustrating the improved performance of a connector of the present invention.
Figure 5B:
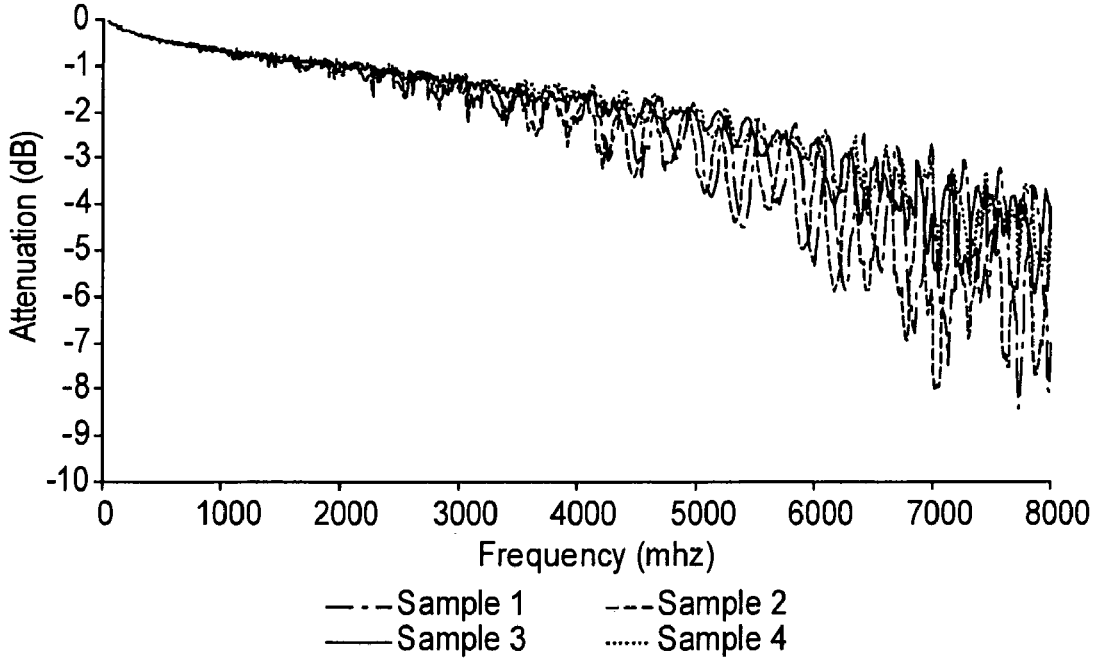
Figure 5C:
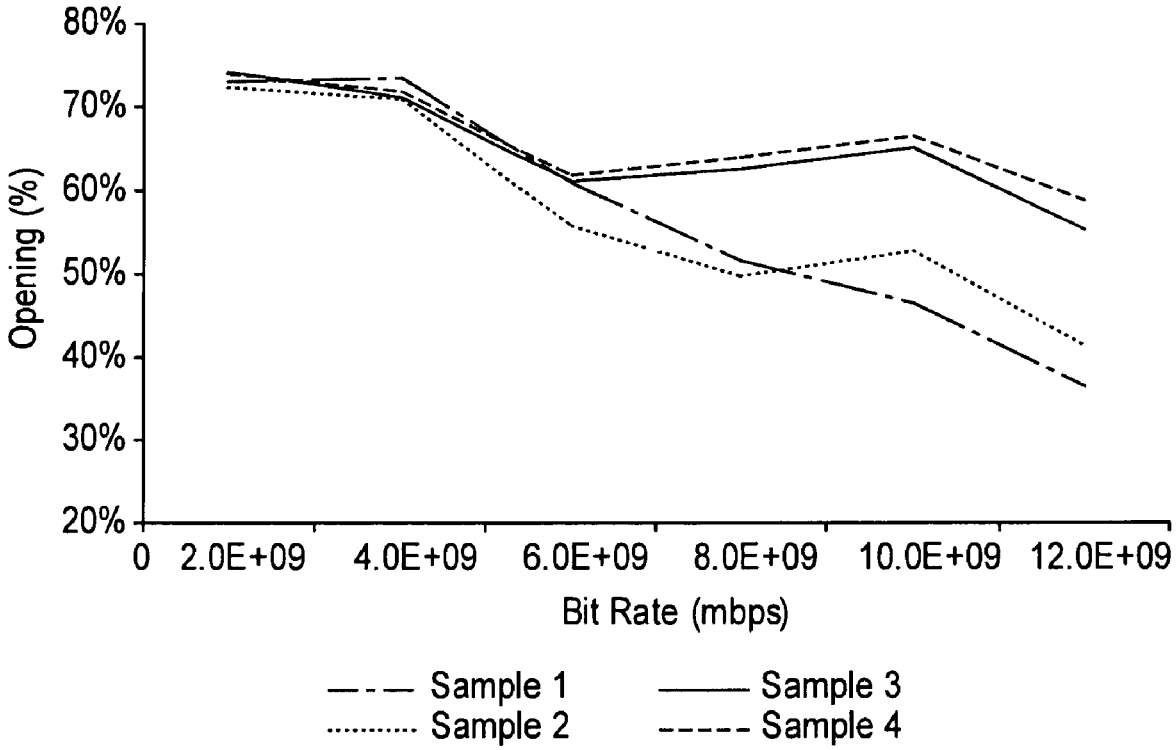

The improved performance obtained by designing the contact positioning features as contact positioning features 118 (illustrated in FIGS. 2 and 3) as opposed to contact positioning features 18 (illustrated in FIG. 1) is dramatic and can be seen from the data presented in FIGS. 5*a*, 5*b*, and 5*c*.

FIG. 5*a* illustrates the impedance profiles of terminated cable assembly 2, represented as Samples 1 and 2, and terminated cable assembly 102, but with substantially solid inner housing center wall 22 (illustrated in FIG. 1), represented as Samples 3 and 4. The test method for creating this data is well known in the art. The data was generated using a Tektronix 50 TDS 8000 50 GHz Scope with an '80E04 TDR Sampling Head. Ideally, a system will have a constant impedance. When designing a terminated cable assembly, one goal is to minimize the changes in impedance as the signal travels through the cable assembly. By minimizing the changes in impedance, distortion and attenuation of the signal are reduced, thereby improving the cable assembly's performance. It can be seen by comparing the impedance profiles that the cable assembly of the present invention using electrical contacts 116 having discontinuous contact positioning features 118 (Samples 3 and 4) provides much greater control over the impedance than the conventional cable assembly (Samples 1 and 2). Specifically, the cable assembly using electrical contacts 116 having discontinuous contact positioning features 118 shows a much smoother impedance profile and a narrower impedance range throughout the cable assembly.

FIG. 5*b* illustrates the attenuation or loss of a sine wave signal traveling through a cable assembly over a range of frequencies. The test method for creating this data is well known in the art. The data was generated using an Agilent 8720ES 50 MHz-20 GHz S-Parameter Network Analyzer. It can be seen by comparing the attenuation plots that the cable assembly of the present invention using electrical contacts 116 having discontinuous contact positioning features 118 (Samples 3 and 4) provides a much lower attenuation or loss than the than the conventional cable assembly (Samples 1 and 2). Specifically, it is generally accepted that an attenuation of greater than −3 dB (equating approximately to Vout/Vin of 0.707) is not acceptable. It can be easily seen from FIG. 5*b* that for the configuration tested, the prior art cable assembly which has continuous contact positioning features provides satisfactory performance only up to about 4200 MHz, but that the cable assembly of the present invention using electrical contacts 116 having discontinuous contact positioning features 118 provides satisfactory performance up to about 5900 MHz. This is clearly a dramatic and unexpected improvement over the conventional cable assembly.

FIG. 5*c* illustrates the percent eye opening as a function of the bit rate. The percent eye opening is a well known method to measure the additive noise in a signal and can be read from an eye pattern, also known as eye diagram. An open eye pattern corresponds to minimal signal distortion. The test method for creating this data is well known in the art. The signals were generated using an Advantest D3186 12 Gbps Pulse Pattern Generator and measured using a Tektronix 50 TDS 8000 50 GHz Scope. It can be easily seen from FIG. 5*c* that the cable assembly of the present invention using electrical contacts 116 having discontinuous contact positioning features 118 maintains a dramatically higher percent eye opening at higher bit rates (i.e. bit rates greater than 6 Gbps) than the conventional cable assembly. This illustrates a dramatic and unexpected improvement in signal performance over the conventional cable assembly.

Further improvement in performance can be achieved by additionally designing the inner housing center wall as substantially hollow inner housing center wall 122 (illustrated in FIGS. 2 and 3) as opposed to substantially solid inner housing center wall 22 (illustrated in FIG. 1).

Figure 6:
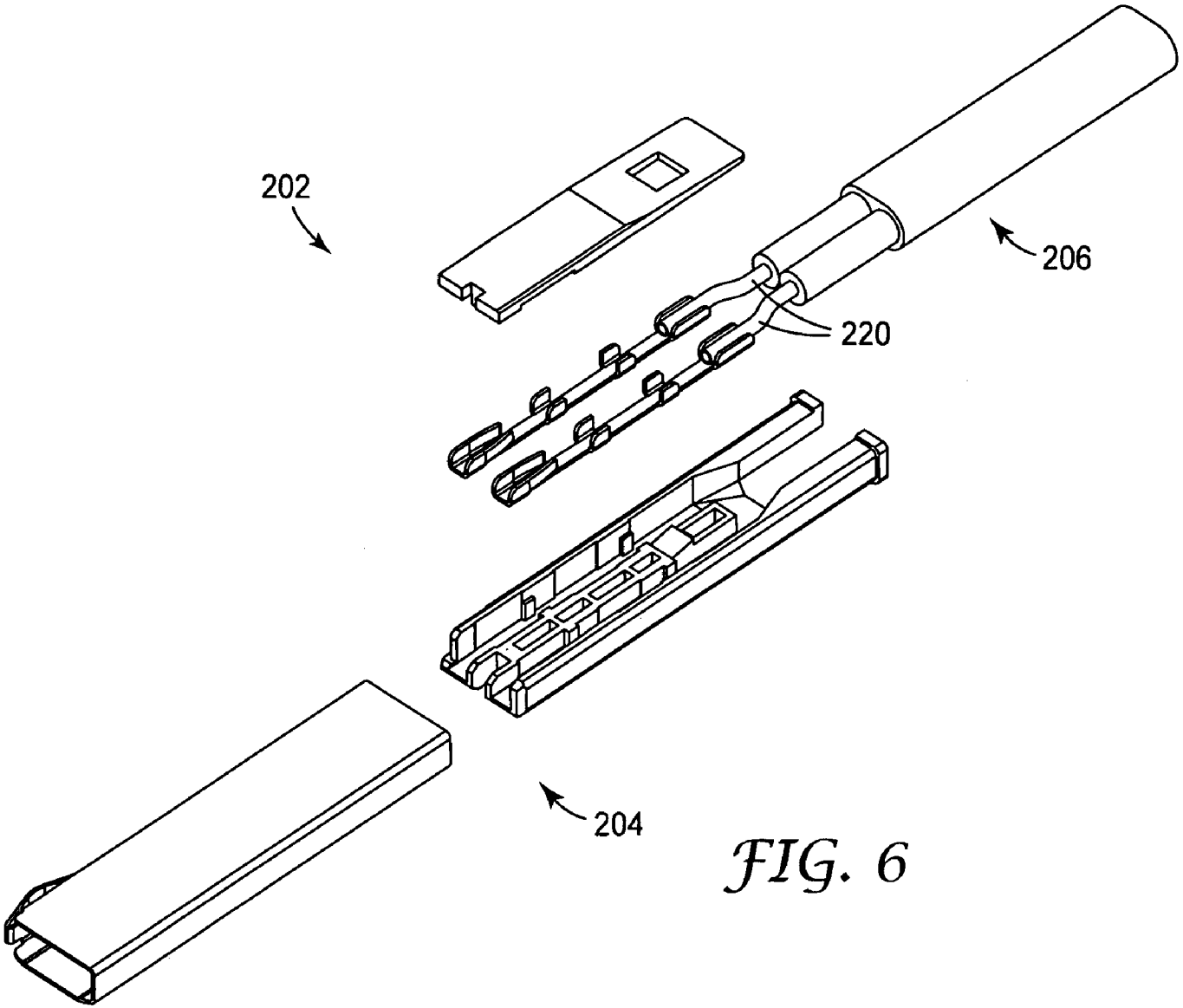
FIG. 6 is an exploded perspective view of another exemplary embodiment of a connector for electrical cables according to the present invention.

FIG. 6 illustrates another exemplary embodiment of the present invention. It shows terminated cable assembly 202 wherein connector for electrical cables 204 is connected to electrical cable 206. In this embodiment, electrical cable 206 is a twinax cable. Connector for electrical cables 204 is similar in design to connector for electrical cables 104 illustrated in FIG. 2, but is configured to accommodate a twinax cable application.

Figure 7:
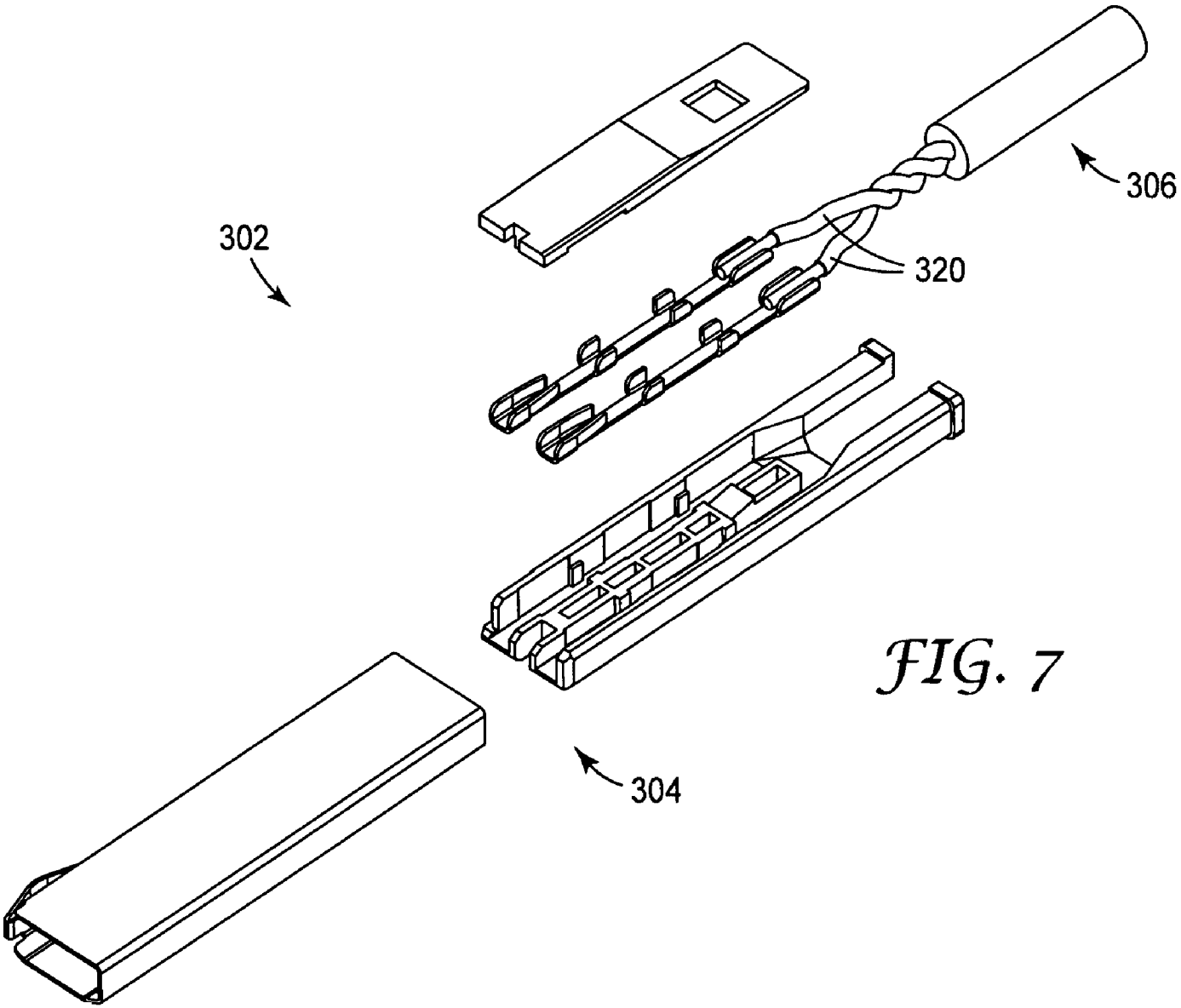
FIG. 7 is an exploded perspective view of another exemplary embodiment of a connector for electrical cables according to the present invention.

FIG. 7 illustrates another exemplary embodiment of the present invention. It shows terminated cable assembly 302 wherein connector for electrical cables 304 is connected to electrical cable 306. In this embodiment, electrical cable 306 is a twisted pair cable. Connector for electrical cables 304 is similar in design to connector for electrical cables 104 illustrated in FIG. 2, but is configured to accommodate a twisted pair cable application.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector for electrical cables comprising:

a tubular housing of electrically conductive material having inner walls defining an opening and first and second opposed open ends;

an inner housing of electrically insulating material adapted to be inserted into the tubular housing from at least one of the open ends thereof, the inner housing comprising inner spaces configured to receive electrical contacts in fixed relative positions; and a plurality of electrical contacts positioned in the inner housing and configured to be connected to a conductor of an electrical cable, the electrical contacts including a plug-in portion, a connection portion, and a contact positioning portion positioned therebetween, the contact positioning portion comprising a discontinuous contact positioning feature, wherein the electrical contacts have a generally u-shaped form including a substantially planar bottom wall and two side walls extending from the bottom wall, wherein the discontinuous contact positioning feature includes first and second sections laterally extending from the bottom wall to a substantially identical height, and wherein the first and second sections include external edges that cooperate with the inner housing to prevent the electrical contact from moving towards the first and second opposed open ends, respectively; and wherein the inner housing further comprises a substantially hollow center wall having a plurality of wall portions and a plurality of wall reinforcement ribs having a thickness substantially the same as a thickness of the wall portions.

2. The connector of claim 1, wherein the discontinuous contact positioning feature comprises one or more apertures.

3. The connector of claim 1, wherein the inner housing is a two part housing.

4. The connector of claim 1, wherein the outer dimensions of the inner housing substantially correspond to the inner dimensions of the tubular housing.

5. The connector of claim 1, wherein the inner housing further comprises a stop at one end configured to engage one of the ends of the tubular housing.

6. The connector of claim 1, wherein the tubular housing comprises one or more external ground contacts.

7. The connector of claim 1, wherein the tubular housing comprises an opening configured to enable electrically connecting a shield of the electrical cable to the tubular housing.

8. The connector of claim 1, wherein the discontinuous contact positioning feature comprises a recess extending to the bottom wall.

9. A terminated cable assembly comprising:

a connector for electrical cables comprising:

a tubular housing of electrically conductive material having inner walls defining an opening and first and second opposed open ends;

an inner housing of electrically insulating material adapted to be inserted into the tubular housing from at least one of the open ends thereof, the inner housing comprising inner spaces configured to receive electrical contacts in fixed relative positions; and a plurality of electrical contacts positioned in the inner housing and configured to be connected to a conductor of an electrical cable, the electrical contacts including a plug-in portion, a connection portion, and a contact positioning portion positioned therebetween, the contact positioning portion comprising a discontinuous contact positioning feature, wherein the electrical contacts have a generally u-shaped form including a substantially planar bottom wall and two side walls extending from the bottom wall, wherein the discontinuous contact positioning feature includes first and second sections laterally extending from the bottom wall to a substantially identical height, and wherein the first and second sections include external edges that cooperate with the inner housing to prevent the electrical contact from moving towards the first and second opposed open ends, respectively; and the electrical cable electrically connected to the connector; and wherein the inner housing further comprises a substantially hollow center wall having a plurality of wall portions and a plurality of wall reinforcement ribs having a thickness substantially the same as a thickness of the wall portions.

10. The terminated cable assembly of claim 9, wherein the discontinuous contact positioning feature comprises one or more apertures.

11. The terminated cable assembly of claim 9, wherein the electrical cable is one of a coaxial cable, a twinaxial cable, and a twisted pair cable.

12. The terminated cable assembly of claim 9, wherein the discontinuous contact positioning feature comprises a recess extending to the bottom wall.

* * * * *